US008290377B2

(12) United States Patent
Ikeda

(10) Patent No.: US 8,290,377 B2
(45) Date of Patent: Oct. 16, 2012

(54) IMAGE FORMING APPARATUS

(75) Inventor: Yuichi Ikeda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 654 days.

(21) Appl. No.: 12/247,071

(22) Filed: Oct. 7, 2008

(65) Prior Publication Data

US 2009/0097868 A1 Apr. 16, 2009

(30) Foreign Application Priority Data

Oct. 12, 2007 (JP) ..... 2007-266330

(51) Int. Cl.
*G03G 15/00* (2006.01)

(52) U.S. Cl. ..... 399/12; 399/25; 399/111

(58) Field of Classification Search ..... 399/12, 399/25, 111
See application file for complete search history.

(56) References Cited

U.S. PATENT DOCUMENTS

2005/0254831 A1* 11/2005 Soga et al. ..... 399/12
2006/0051106 A1* 3/2006 Takahashi et al. ..... 399/12

FOREIGN PATENT DOCUMENTS

JP 6-014167 A 1/1994
JP 2005-345788 A 12/2005
JP 2006-227293 A 8/2006
JP 2006-267706 A 10/2006

OTHER PUBLICATIONS fixyourownprinter.com Oct. 18, 2004.*

* cited by examiner

*Primary Examiner* — Walter L Lindsay, Jr.
*Assistant Examiner* — Roy Y Yi
(74) *Attorney, Agent, or Firm* — Canon USA, Inc., IP Division

(57) ABSTRACT

An image forming apparatus includes cartridges mounted to the main body of the image forming apparatus and including at least developing devices that develop latent images, formed on image bearing members, into toner images. The image forming apparatus forms an image onto a recording material. In the apparatus, for the developing devices, first and second cartridges containing toners having the same hue and having different brightnesses may be exchanged with respect to the main body of the image forming apparatus for use. In addition, a maximum toner amount with respect to the image bearing member when the first cartridge is used is made different from a maximum toner amount with respect to the image bearing member when the second cartridge is used.

5 Claims, 16 Drawing Sheets

WHEN TONER AMOUNT IS NOT SPECIFIED AS BEING SMALL
(MAXIMUM WEIGHT OF TONER IN IMAGE AREA WHERE IMAGE AREA RATIO IS 100%: 0.5 mg/cm$^2$)

ta: UNFIXED TONER
P: RECORDING MATERIAL

WHEN TONER AMOUNT IS SPECIFIED AS BEING SMALL
(MAXIMUM WEIGHT OF TONER IN IMAGE AREA WHERE IMAGE AREA RATIO IS 100%: 0.3 mg/cm$^2$)

FIXED IMAGE IN FIG. 13A tb: FIXED TONER

P: RECORDING MATERIAL

FIXED IMAGE IN FIG. 13B

IMAGE FORMING APPARATUS

BACKGROUND OF THE INVENTION

1. Field of the Invention

The present invention relates to an image forming apparatus using an electrophotography method or an electrostatic recording method, and, more particularly, to an image forming apparatus, such as a copying machine, a printer, or a facsimile.

2. Description of the Related Art

Nowadays, a demand for reducing running cost in terms of image output of an electrophotography image forming apparatus is increasing more and more. To meet this demand, the amount of toner consumption may be reduced.

For example, hitherto, a toner saving mode in which the amount of toner consumption is less than the amount of toner consumption in an ordinary mode is provided (refer to Japanese Patent Laid-Open No. 6-14167). More specifically, when the toner saving mode is selected, a development bias is changed from a development bias in the ordinary mode, to perform a controlling operation that reduces the amount of toner used for development.

However, when, as in the apparatus discussed in Japanese Patent Laid-Open No. 6-14167, the amount of toner consumption is reduced, the density of an output image may be reduced with respect to an original image.

In an image forming apparatus using both dark toner and light toner having different brightnesses and the same hue, when the amount of toner consumption is to be reduced, the dark toner may be selectively used to form an image, whereas, when image quality is given priority, the dark toner and the light toner may both be used to form an image.

However, in such a structure, an image forming section for the dark toner and an image forming section for the light toner need to be provided. Therefore, the apparatus is increased in size and becomes sophisticated.

SUMMARY OF THE INVENTION

The present invention provides an image forming apparatus having a simple structure that can satisfy demands in which tone reproduction is important and demands in which running cost is important.

According to an aspect of the present invention, there is provided an image forming apparatus comprising a mounting device and a controller. The mounting device is configured to detachably mount selected one of cartridges including a first cartridge and a second cartridge which form a toner image with same hue toner. The density of the toner contained in the first cartridge is higher than the density of the toner contained in the second cartridge. The controller is configured to change an image forming condition so that maximum amount per unit area of the toner used when the first cartridge is mounted to the mounting device is smaller than maximum amount per unit area of the toner used when the second cartridge is mounted to the mounting device.

According to another aspect of the present invention, there is provided an image forming apparatus comprising a mounting device and a controller. The mounting device is configured to detachably mount selected one of cartridges including a first cartridge and a second cartridge which form a toner image with same hue toner. Pigment amount per unit weight of the toner contained in the first cartridge is higher than pigment amount per unit weight of the toner contained in the second cartridge. The controller is configured to control so that an image forming condition when the first cartridge is mounted to the mounting device is different from an image forming condition when the second cartridge is mounted to the mounting device.

Further features of the present invention will become apparent from the following description of exemplary embodiments with reference to the attached drawings.

DESCRIPTION OF THE EMBODIMENTS

Exemplary embodiments of the present invention will be described in detail with reference to the drawings.

In the exemplary embodiments, a cartridge comprises at least a developing unit. The cartridge is removably mounted to the main body of an image forming apparatus. Another exemplary cartridge may comprise a developing unit and a photosensitive member, integrated to each other, and may be removably mounted to the main body of the image forming apparatus. Accordingly, since a user can mount the cartridge to and remove it from the main body of the image forming apparatus by himself/herself, the image forming apparatus can be easily maintained.

First Embodiment (1) Schematic Structure of Exemplary Image Forming Apparatus

Figure 1:
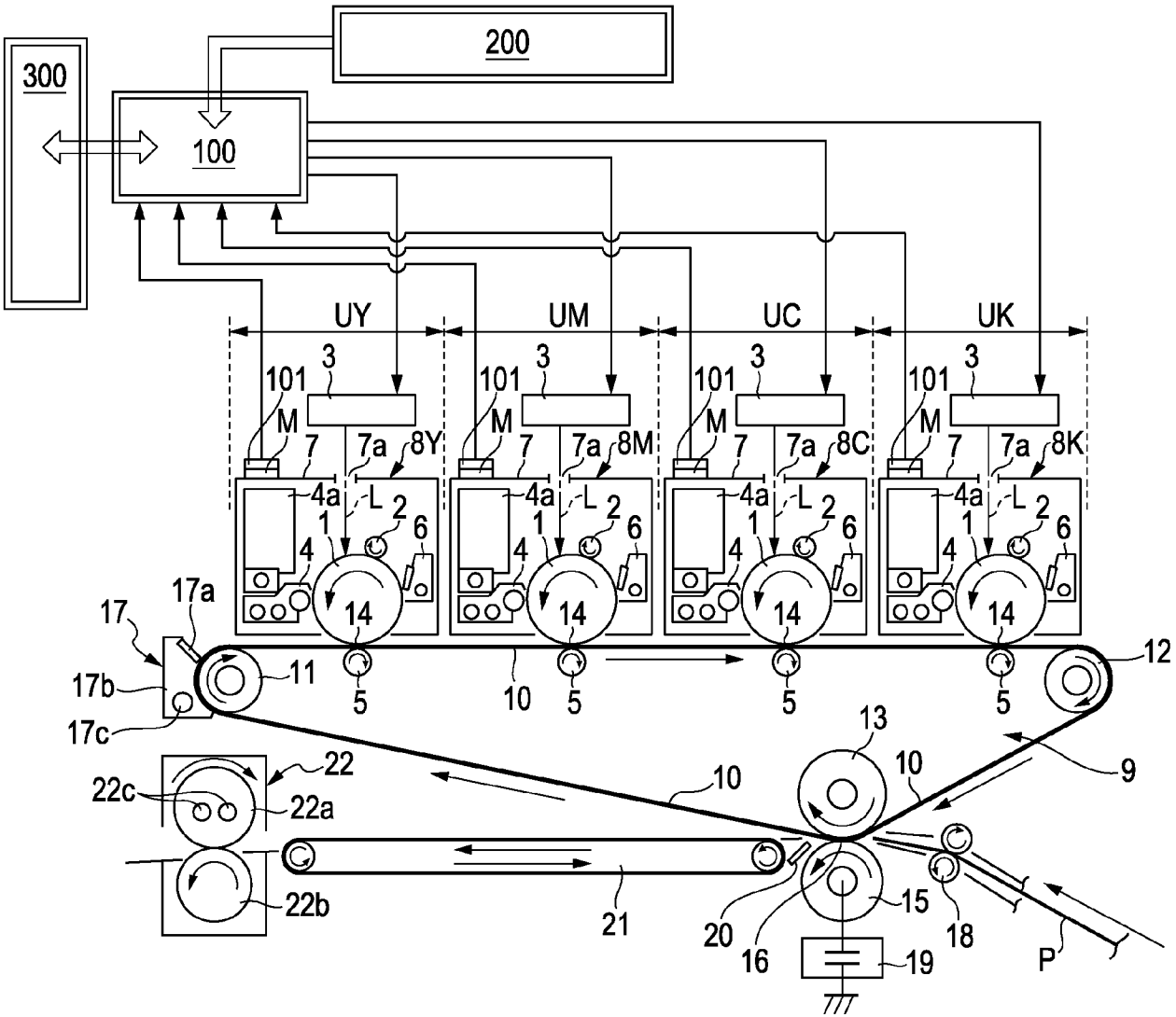
FIG. 1 is a schematic view of the structure of an image forming apparatus according to a first embodiment of the present invention.

FIG. 1 is a schematic view of the structure of an image forming apparatus according to a first embodiment of the present invention. The image forming apparatus is a four-color full-color electrophotography apparatus using an in-line (tandem) method and an intermediate transfer method, and is a multifunction apparatus functioning as a copying machine, a printer, and a facsimile.

In a copying-machine mode, electrical image information of an original, on which color-separation photoelectric reading is performed by an image reader (image scanner) 200 using three primary colors (red (R), green (G), and blue (B)), is input to an image processing unit (not shown) of a controller 100. The image reader 200 is installed in the image forming apparatus. The controller 100 is a controlling circuit unit (serving as a controlling unit) that performs an overall controlling operation on the image forming apparatus. The controller 100 exchanges an electrical signal with the image reader 200 and an external device 300, and exchanges an electrical signal with various process devices of an image forming mechanism, to control an image formation sequence. The electrical image information of the original, input to the image processing unit of the controller 100, is processed into a yellow component image signal, a magenta component image signal, a cyan component image signal, and a black component image signal, so that the image forming apparatus functions as a copying machine.

In a printer mode, electrical image information from a personal computer, serving as the external device 300, is input to the image processing unit of the controller 100, so that the image forming apparatus functions as a printer.

In a facsimile reception mode, electrical image information from a facsimile device of another party, serving as the external device 300, is input to the image processing unit of the controller 100, so that the image forming apparatus functions as a facsimile receiving apparatus.

In a facsimile transmission mode, electrical image information of an original, photoelectrically read out by the image reader 200, is input to the controller 100. When the controller 100 transmits the electrical image information to a facsimile device of another party, serving as the external device 300, the image forming apparatus functions as a facsimile transmitting apparatus.

Reference characters UY, UM, UC, and UK denote four image forming sections (image forming stations) that are disposed in parallel horizontally from left to right and in a tandem arrangement in the image forming apparatus in FIG. 1. More specifically, reference character UY denotes the yellow (Y-color) image forming section, reference character UM denotes the magenta (M-color) image forming section, reference character UC denotes the cyan (C-color) image forming section, and reference character UK denotes the black (K-color) image forming section.

The image forming sections UY, UM, UC, and UK each comprise an electrophotography photosensitive member (hereunder referred to as "photosensitive drum") 1 (serving as an image bearing member), a primary charging unit 2, an exposure unit 3, a developing device 4, a primary transfer unit 5, and a cleaning unit 6. A charging roller is used for each primary charging unit 2. Each exposure unit 3 irradiates the photosensitive drum 1 with light to form a latent image on the photosensitive drum 1, and is a digital exposure unit, such as an LED or laser. Each exposure unit 3 may be an analog exposure unit. In the embodiment, a laser scanning exposure unit (scanner unit) is used. For each developing device 4, a developing device using a toner projection development method, a two-component development method, or a FEED development method may be used. For each developing device 4, image exposure and reversal development are often combined for use. A primary transfer roller is used for each primary transfer unit 5. A blade cleaning unit is used for each cleaning unit 6.

In the Y-color image forming section UY, a supplying unit 4*a* supplies Y-color toner to the developing device 4 to form a Y-color toner image on the surface of the photosensitive drum. In the M-color image forming section UM, a supplying unit 4*a* supplies M-color toner to the developing device 4 to form an M-color toner image on the surface of the photosensitive drum. In the C-color image forming section UC, a supplying unit 4*a* supplies C-color toner to the developing device 4 to form a C-color toner image on the surface of the photosensitive drum. In the K-color image forming section UK, a supplying unit 4*a* supplies K-color toner to the developing device 4 to form a K-color toner image on the surface of the photosensitive drum.

An intermediate transfer belt unit 9 is disposed below the four image forming sections UY, UM, UC, and UK. The unit 9 comprises a flexible endless belt 10 (intermediate transfer belt; hereunder referred to as "belt") serving as an intermediate transfer member that contacts the lower surfaces of the photosensitive drums 1 of the respective image forming sections UY, UM, UC, and UK. The belt 10 is formed of dielectric resin, such as polyimide, polycarbonate, polyethylene terephthalate, or polyvinylidene fluoride. The unit 9 also comprises a driving roller 11, a turn roller 12, and a secondary transfer inner roller 13, around which the belt 10 is stretched to move in an endless manner. The lower surfaces of the photosensitive drums 1 of the respective image forming sections UY, UM, UC, and UK are in contact with the upper surface of the upper portion of the belt between the driving roller 11 and the turn roller 12. The four primary transfer rollers 5 are disposed at the inner side of the belt 10 so as to oppose the photosensitive drums 1 of the respective image forming sections UY, UM, UC, and UK through the upper portion of the belt. In the image forming sections, contact nips between the belt 10 and the photosensitive drums 1 of the respective image forming sections UY, UM, UC, and UK correspond to primary transfer sections 14. A secondary transfer outer roller 15 is in contact with the secondary transfer inner roller 13 through the belt 10. A contact nip between the belt 10 and the secondary transfer inner roller 13 corresponds to a secondary transfer section 16. A belt cleaner 17 is disposed where the belt is stretched around the driving roller 11. A blade cleaner is used as the belt cleaner 17.

In each of the four image forming sections UY, UM, UC, and UK, a cartridge comprising at least a developing device 4 that develops a latent image, formed on the photosensitive drum 1, into a toner image is removably mounted to the main body of the image forming apparatus. In the embodiment, process cartridges (CRG) 8Y, 8M, 8C, and 8K, in which photosensitive drums 1 are integrally formed with several process units that act upon the photosensitive drums, are formed in the respective image forming sections. More specifically, the photosensitive drums 1, the charging rollers 2, the developing devices 4 (including supplying units 4*a*), and the cleaning units 6 are integrally mounted within cartridge frames 7, to form the cartridges 8Y, 8M, 8C, and 8K that are removably mounted to the main body of the image forming apparatus for use. Each of the cartridges is provided with a memory tag M. Each memory tag M is provided with a memory and a communication section that performs communication with a memory tag reader (communication unit) 101 (described later). Each memory stores various items of information regarding the corresponding cartridge.

Hereunder, the cartridge 8Y may be referred to as a Y-color cartridge, the cartridge 8M may be referred to as an M-color cartridge, the cartridge 8C may be referred to as a C-color cartridge, and the cartridge 8K may be referred to as a K-color cartridge. In the embodiment, the cartridges 8Y, 8M, 8C, and 8K have the same structure, and differ only in the colors of the toners that they contain. The cartridges 8Y, 8M, 8C, and 8K contain Y-color toner, M-color toner, C-color toner, and K-color toner, respectively.

The main body of the image forming apparatus is provided with four mounting devices to which the Y-color, M-color, C-color, and K-color cartridges are removably mounted. The cartridges 8Y, 8M, 8C, and 8K that are mounted to the respective mounting devices are held while they are positioned and secured at predetermined positioning portions by positioning units (not shown). A driving output portion (not shown) at the main-body side of the image forming apparatus is connected to driving input portions (not shown) at the respective cartridges. A power supply (not shown) at the main-body side of the image forming apparatus is connected to electrical contacts (not shown) of the cartridges. The memory tags M of the cartridges 8Y, 8M, 8C, and 8K predeterminately oppose the respective memory tag readers (communication units) 101 serving as a discriminating device at the main-body side of the image forming apparatus. This allows the various items of information that are stored in the memory tags M to be read into the controller 100 through the memory tag readers (communication units) 101. More specifically, the memory tag readers (communication units) 101 read the types of cartridges mounted to the mounting devices, that is, information for discriminating between first and second cartridges, and send this information to the controller. From the controller 100, various items of information are written on the memory tags M through the memory tag readers (communication units) 101.

The operations for forming a full-color image are as follows. The photosensitive drums 1 of the respective image forming sections UY, UM, UC, and UK are rotationally driven at a predetermined control speed (process speed) counterclockwise in the direction of the arrows. In the embodiment, the process speed is 100 mm/s. The belt 10 is also rotationally driven clockwise in the direction of the arrows (forward direction in relation to the rotation of the drums) at a speed corresponding to the speed of the photosensitive drums 1. Each scanner unit 3, serving as a light-irradiation unit, is also driven. In synchronism with this driving operation, in each image forming section, the charging roller 2 uniformly primarily charges the surface of the photosensitive drum 1 to a predetermined polarity/electrical potential at a predetermined control timing. Then, the controller 100 outputs a Y-component image signal of the full-color image to the scanner unit 3 of the Y-color image forming section UY at a predetermined control timing. The controller 100 outputs an M-component image signal of the full-color image to the scanner unit 3 of the M-color image forming section UM at a predetermined control timing. The controller 100 outputs a C-component image signal of the full-color image to the scanner unit 3 of the C-color image forming section UC at a predetermined control timing. The controller 100 outputs a K-component image signal of the full-color image to the scanner unit 3 of the K-color image forming section UK at a predetermined control timing. Each scanner unit 3 scans and exposes the surface of the corresponding photosensitive drum 1 to laser light L that has been modulated in correspondence with the image signal of the corresponding color. The scanning and exposure operations are performed in the cartridges 8Y, 8M, 8C, and 8K through exposure windows 7*a* of the cartridge frames 7. This forms electrostatic latent images corresponding to the image signals of the respective colors on the surfaces of the respective photosensitive drums 1. The developing devices 4 develop the formed electrostatic latent images into toner images. In the embodiment, charging polarity of the primary charging of the photosensitive drums 1 is negative. Toner charging polarity is also negative. Image exposure and reversal development are combined.

By the aforementioned electrophotography image-formation process, a Y-color toner image corresponding to the Y component of the full-color image is formed on the photosensitive drum 1 of the Y-color image forming section UY, and is primarily transferred onto the belt 10 at the primary transfer section 14 of the Y-color image forming section UY.

An M-color toner image corresponding to the M component of the full-color image is formed on the photosensitive drum 1 of the M-color image forming section UM, and is superposed upon and primarily transferred onto the Y-color toner image, already transferred on the belt 10, at the primary transfer section 14 of the M-color image forming section UM.

A C-color toner image corresponding to the C component of the full-color image is formed on the photosensitive drum 1 of the C-color image forming section UC, and is superposed upon and primarily transferred onto the Y-color toner image and the M-color toner image, already transferred on the belt 10, at the primary transfer section 14 of the C-color image forming section UC.

A K-color toner image corresponding to the K component of the full-color image is formed on the photosensitive drum 1 of the K-color image forming section UK, and is superposed upon and primarily transferred onto the Y-color toner image, the M-color toner image, and the C-color toner image, already transferred on the belt 10, at the primary transfer section 14 of the K-color image forming section UK.

Accordingly, the unfixed Y-, M-, C-, K-color toner images of the full-color image are combined and formed on the belt 10.

In each of the image forming sections UY, UM, UC, and UK, the primary transfer of the toner image onto the belt 10 from the corresponding photosensitive drum 1 is electrostatically performed by applying primary transfer bias at a predetermined control timing to the corresponding primary transfer roller 5 by a bias application power supply (not shown). The primary transfer bias is a direct-current bias having a polarity that is opposite to the toner charging polarity and that is controlled to a predetermined electrical potential.

Figure 2:
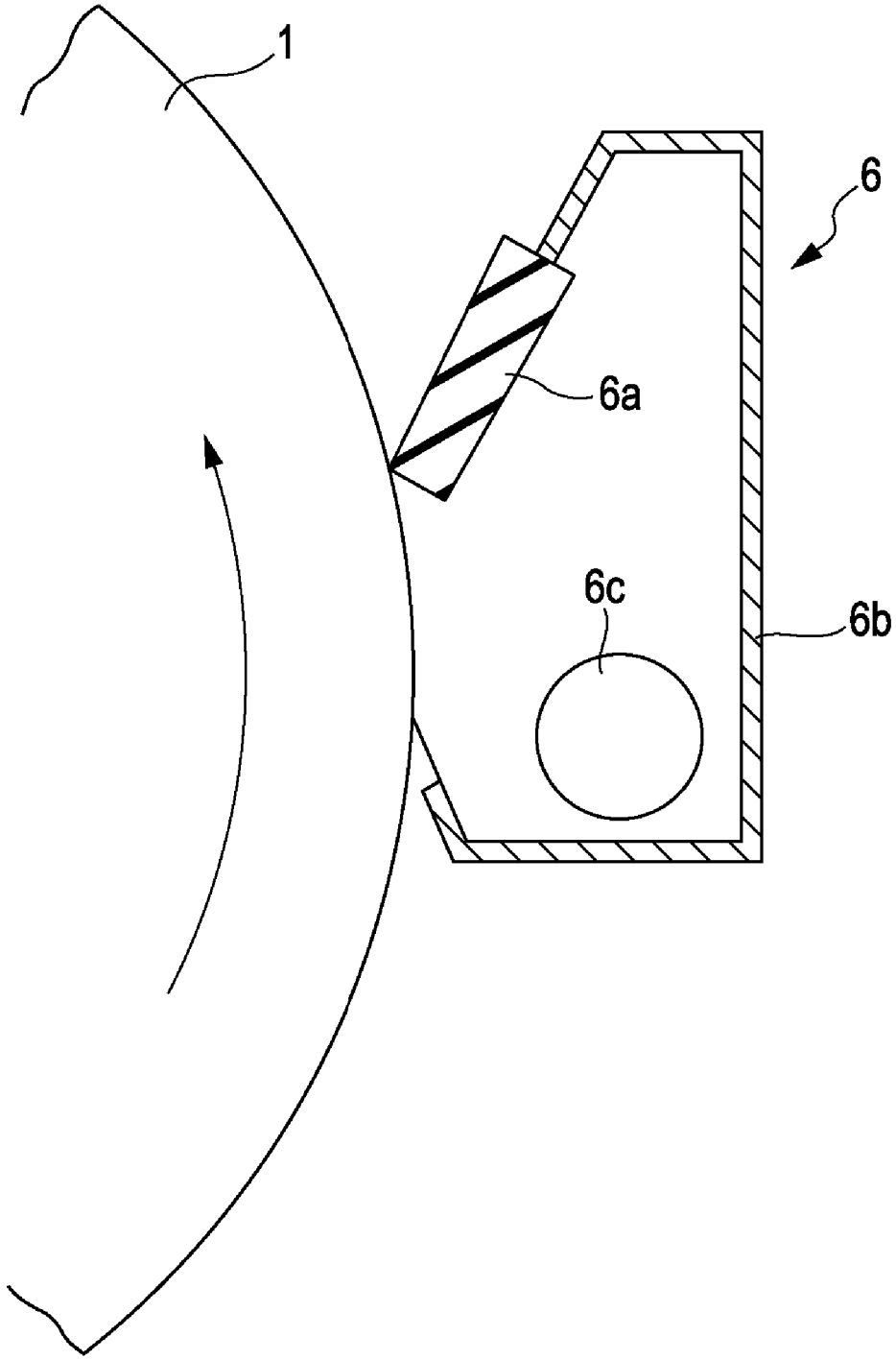
FIG. 2 is an enlarged view of a cleaning unit of a photosensitive drum.

In each of the image forming sections, any toner remaining on the surface of the corresponding photosensitive drum 1 (primary-transfer remaining toner) and not having been transferred onto the belt 10 during the primary transfer is scraped off and removed from the surface of the corresponding photosensitive drum 1 by a corresponding cleaning blade 6*a* (see FIG. 2) of the cleaning unit 6. Then, each waste-toner conveying screw 6*c*, disposed in its corresponding cleaner container 6*b*, sends the remaining toner from the inside of the cleaner container 6*b* to a waste-toner container (not shown), disposed at the main-body side of the image forming apparatus. Accordingly, each photosensitive drum 1 whose surface has been cleaned is subjected to a next image formation operation.

At a predetermined control timing, a recording material P is fed from a sheet-feed mechanism (not shown), and is sent to registration rollers 18. The registration rollers 18 correct oblique movement of the recording material P, and control a timing of a secondary transfer of a toner image onto the recording material P from the belt 10. In addition, the registration rollers 18 receive an edge of the recording material P fed from the sheet-feed mechanism, and temporarily stops the recording material P. Then, the registration rollers 18 rotationally driven at a predetermined control timing introduce the recording material P to the secondary transfer section 16 to nip and convey the recording material P. While the recording material P passes through the secondary transfer section 16, a secondary transfer bias application power supply 19 applies a secondary transfer bias to the secondary transfer roller 15. The secondary transfer bias has a polarity that is opposite to the toner charging polarity, and has a predetermined electrical potential. This causes the unfixed toner images of the full-color image on the belt 10 to be electrostatically secondarily transferred onto the surface of the recording material P all together.

The recording material P that has moved out of the secondary transfer section 16 is separated from the surface of the belt 10, and is introduced into a fixing unit 22 by a conveying belt unit 21.

Any secondary-transfer remaining toner, remaining on the surface of the belt 10 after separating the recording material P, is scraped off and removed from the surface of the belt by a cleaning blade 17*a* of the cleaner 17. Then, a waste-toner conveying screw 17*c*, disposed in a cleaner container 17*b*, sends the remaining toner from the inside of the cleaner container 17*b* to the waste-toner container (not shown), disposed at the main-body side of the image forming apparatus. Accordingly, the belt 10 whose surface has been cleaned is subjected to a next image formation operation.

A heat roller fixing unit is used as the fixing unit 22. The fixing unit 22 comprises a fixing roller (heat roller) 22*a* and a pressing roller 22*b*. The fixing roller 22*a* comprises heaters 22*c* in its interior. The rollers 22*a* and 22*b* are press-contacted to each other, so that a fixing nip is formed. The recording material P is nipped and conveyed by the fixing nip. This causes the unfixed toner images of the full-color image on the recording material P to be fixed by pressure and heat. Then, the recording material P moves out of the fixing unit 22, and is discharged as an object on which the full-color image is formed.

Reference numeral 20 denotes a patch detector. The patch detector 20 comprises an LED and a photodetector. The patch detector 20 forms toner image patches of respective colors, serving as control standards of image formation, on the belt 10, and reads the amount of light reflection of the patches. The controller 100 computes a toner amount on the belt 10 from the amount of light reflection of the toner image patches on the belt 10 that have been read by the patch detector 20, and controls image control conditions (such as charging electrical potential and T/C ratio control) from the computation result.

(2) Image Quality and Running Costs

In the embodiment, the demands of a user for whom high quality image is important and the demands of a user for whom running costs are important are met as follows.

For each of the Y-color cartridge 8Y, M-color cartridge 8M, C-color cartridge 8C, and K-color cartridge 8K, two types of cartridges, that is, a first cartridge and a second cartridge, which contain toners having the same hue and having different covering powers, are provided. The first and second cartridges can be interchanged with respect to the main body of the image forming apparatus for proper use. That is, for the developing devices 4, first and second cartridges, which contain toner having the same hue and having different brightnesses, may be replaced with respect to the image forming apparatus for use. A maximum toner amount with respect to the main body of the photosensitive drum 1 (serving as an image bearing member) when the first cartridge is used is different from that when the second cartridge is used.

When costs are important, the toner consumption amount can be reduced when a cartridge containing high covering toner is mounted to form an image. On the other hand, when high image quality is important, a high image quality can be achieved when the cartridge is replaced with one containing low covering toner to form an image.

Here, the principle of achieving a high image quality as a result of forming an image using low covering toner will be described.

Figure 13A:
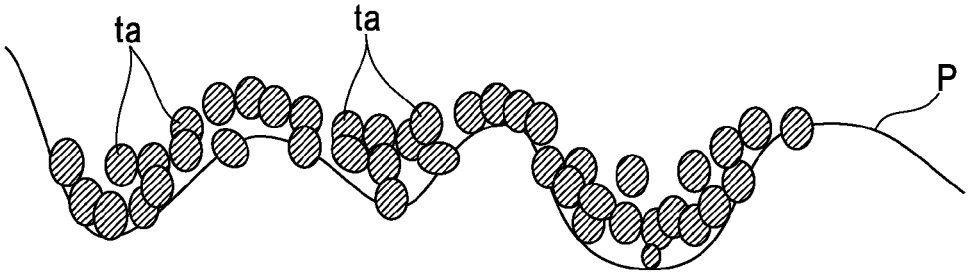
FIGS. 13A and 13B each illustrate an unfixed toner image before fixing when a surface of a recording material is not smooth.
Figure 13B:
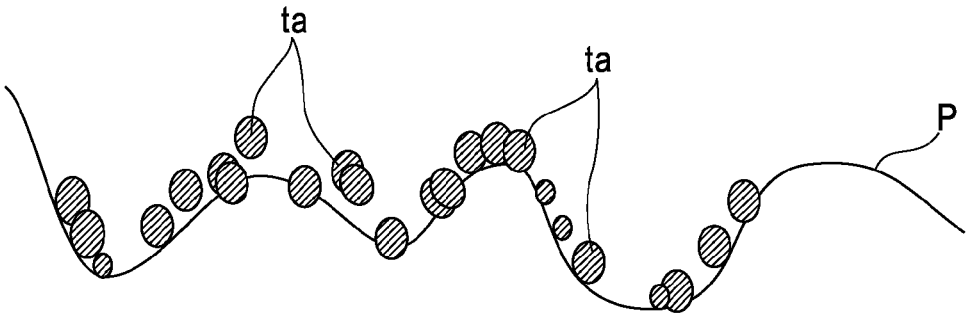

When the surface of the recording material is not smooth, unfixed toner images before fixing are as shown in FIGS. 13A and 13B.

FIG. 13A is a sectional distribution schematic view of an unfixed toner image ta on a recording material P when a toner amount is not specified as being small. A maximum toner weight is 0.5 mg/cm$^2$ in an image area having an image area ratio of 100%. FIG. 13B is a sectional distribution schematic view of an unfixed toner image ta on a recording material P when a toner amount is specified as being small. A maximum toner weight is 0.3 mg/cm$^2$ in an image area having an image area ratio of 100%.

As shown in FIG. 13A, when the toner amount is large, the toner ta uniformly covers the surface of the recording material P, so that, even if the recording material P has a dense fiber portion and a sparse fiber portion, the toner ta uniformly covers the surface of the recording material.

In contrast, as shown in FIG. 13B, when the toner amount is small, the toner ta cannot uniformly cover the surface of the recording material. Therefore, the surface of the recording material P is exposed from a gap between the toners.

Figure 14A:
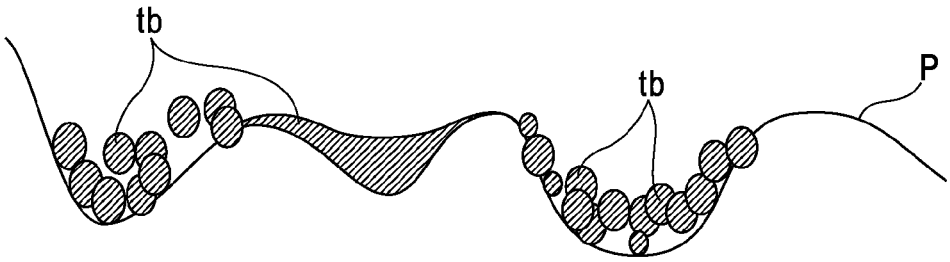
FIGS. 14A and 14B each illustrate a case in which the unfixed toner image is fixed.
Figure 14B:
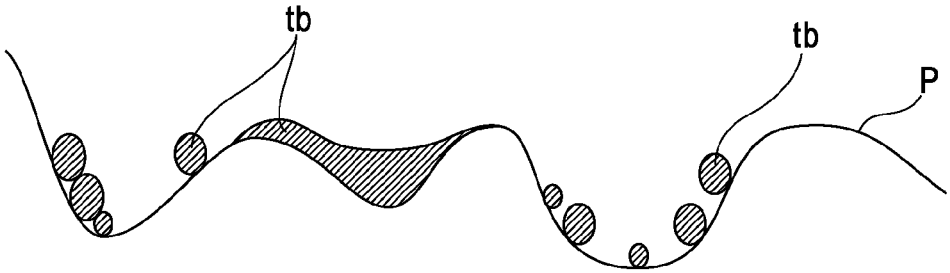

The cross sections when the unfixed images are fixed in such states are as shown in FIGS. 14A and 14B. FIG. 14A is a sectional schematic view of the image after fixing the image in FIG. 13A. FIG. 14B is a sectional schematic view of the image after fixing the image in FIG. 13B.

In FIG. 14A, the percentage at which the toner image at the dense fiber portion of the recording material P exists on the surface of the recording material is large. Accordingly, the toner image tb sufficiently contacts a heating fixing member, and is sufficiently melted. Therefore, the toner image tb is formed into a bulk image, so that it uniformly covers and is fixed to the surface of the recording material. In contrast, in the sparse fiber portion of the recording material P, toner particles tb fall between the fibers. Therefore, the fallen toner tb cannot sufficiently contact the heating fixing member, as a result of which the toner tb is not sufficiently melted. However, even if the toner tb is not sufficiently melted, since it is heavy, the toner can cover the surface of the recording material. Consequently, a high quality image can be achieved.

In contrast, as shown in FIG. 14B, when the toner amount is small, toner particles tb at the dense fiber portion of the recording material P are sufficiently melted, and are formed into a bulk, so that the toner particles tb uniformly cover the surface of the recording material, and are fixed thereto. However, at the sparse fiber portion of the recording material, toner tb that has fallen between the fibers does not uniformly cover the recording material, and is insufficiently melted. Therefore, the fixing operation is performed while the surface of the recording material has a portion without a toner layer tb. As a result, in FIG. 14A, a good image density can be achieved, whereas, in FIG. 14B, the sheet fibers appear between the gaps of the toners, thereby making it difficult to achieve a high image quality compared to that in FIG. 14A.

Accordingly, in the embodiment, the first and second cartridges, which contain toner having the same hue and having different covering powers, are properly used on the basis of whether high image quality is important or reducing toner consumption amount is important. Consequently, an image of high quality can be formed. In addition, in a toner-consumption-amount reduction mode, high covering toner is used to make it possible to reduce the toner consumption amount while restricting density reduction.

Figure 3:
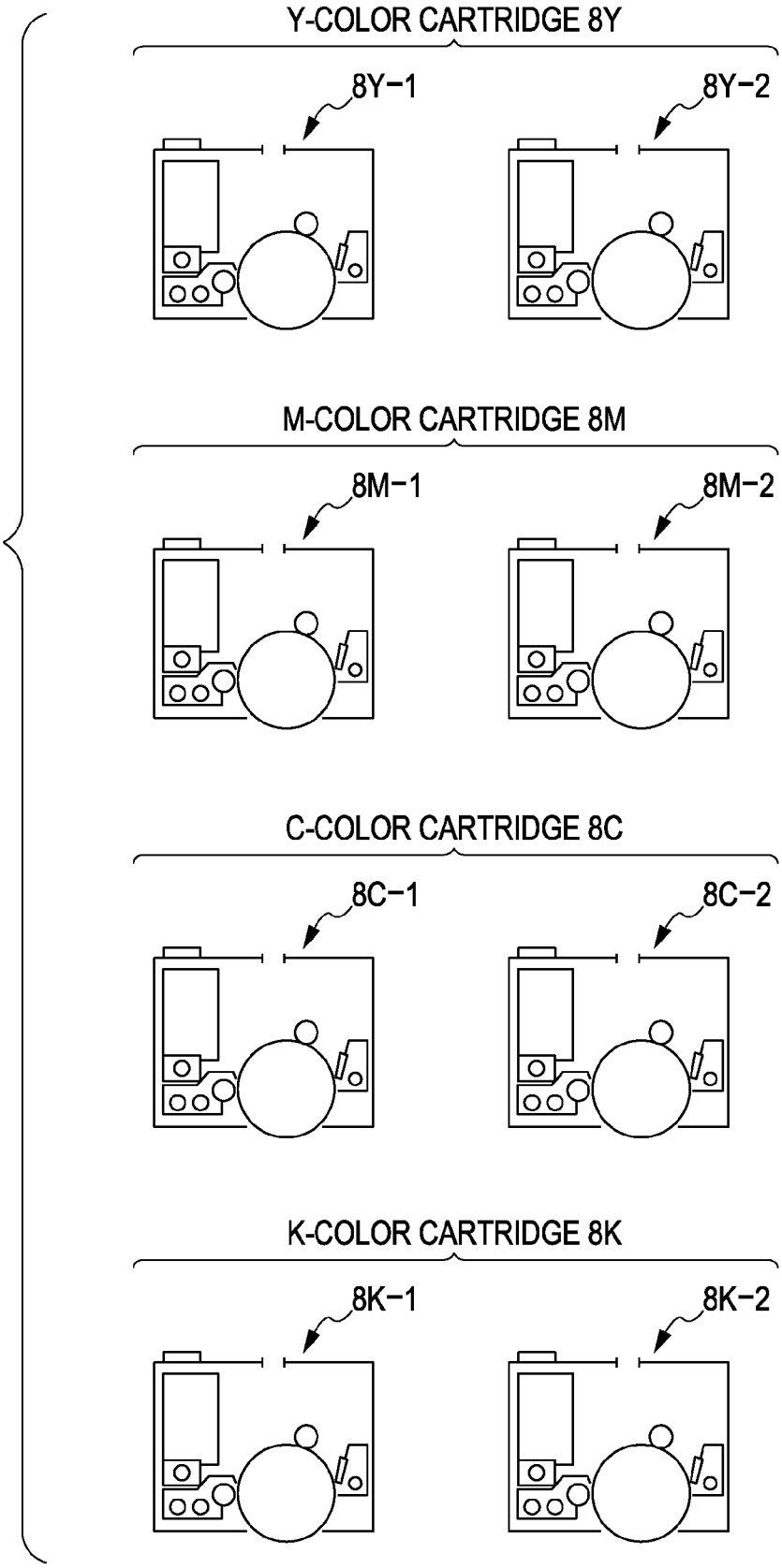
FIG. 3 shows first cartridges, containing high covering toner, and second cartridges, containing ordinary toner. The first and second cartridges are provided as process cartridges of respective colors, yellow (Y), magenta (M), cyan (C), and black (K).

In FIG. 3, in the Y-color cartridge 8Y, reference numerals 8Y-1 and 8Y-2 denote first and second cartridges containing Y-color toners having the same hue and different brightnesses (hereunder, "having different brightnesses" may be expressed as "having different covering powers"). In the M-color cartridge 8M, reference numerals 8M-1 and 8M-2 denote first and second cartridges containing M-color toners having the same hue and different covering powers. In the C-color cartridge 8C, reference numerals 8C-1 and 8C-2 denote first and second cartridges containing C-color toners having the same hue and different covering powers. In the K-color cartridge 8K, reference numerals 8K-1 and 8K-2 denote first and second cartridges containing K-color toners having the same hue and different covering powers.

In the foregoing description, the covering power corresponds to the mutual relationship between the toner amount and the density. Toners having different covering powers correspond to toners having different toner amounts (mg/cm$^2$) per unit area required for obtaining images of the same density for the toners having the same hue. Toners having small toner amounts per unit area required for obtaining images of the same density have high covering powers. That is, they are high covering toners having high coloration amount. Accordingly, the amount of toner used for obtaining images of the same density may be small. In other words, high-covering toner refers to toner having the same hue and having low brightness.

Accordingly, in the embodiment, in each cartridge of the corresponding color, the first and second cartridges containing toners having the same hue and having different covering powers are properly used for the developing devices. In addition, in properly using the first and second cartridges, the maximum amount of low covering toner and the maximum amount of high covering toner are changed, to make it possible to restrict density variations. Accordingly, the demands of a user for whom high image quality is important and the demands of a user for whom running costs are important can be met without increasing the size of the apparatus.

The maximum toner amount can be changed by changing the development contrasts in the first cartridge and the second cartridges. Alternatively, this can be achieved by changing toner charging amounts per unit weight in the first cartridges and the second cartridges. Further, this can be achieved by changing maximum exposure amounts in the first and second cartridges.

What is discussed above will hereunder be described in more detail. In the embodiment, the first cartridges 8Y-1, 8M-1, 8C-1, and 8K-1 each contain ordinary toner (having ordinary covering power) as toner of its corresponding color. The second cartridges 8Y-2, 8M-2, 8C-2, and 8K-2 each contain high covering toner having a covering power that is higher than that of ordinary toner, and having the same hue as the ordinary toners contained in the first cartridges.

When a high-quality image is to be output (that is, when high image quality is important), the first cartridges 8Y-1, 8M-1, 8C-1, and 8K-1 are mounted to the main body of the image forming apparatus for use. In contrast, when the toner amount is to be reduced (that is, when running cost is important), the second cartridges 8Y-2, 8M-2, 8C-2, and 8K-2 are mounted to the main body of the image forming apparatus for use.

That is, two sets of cartridges, that is, the set containing the first cartridges 8Y-1, 8M-1, 8C-1, and 8K-1 (containing ordinary toner) and the set containing the second cartridges 8Y-2, 8M-2, 8C-2, and 8K-2 (containing high covering toner) are provided. When a high-quality image is to be output, or when the toner amount is to be reduced, the first cartridge set containing ordinary toner or the second cartridge set containing high covering toner is properly used with respect to the main body of one image forming apparatus.

The controller 100 can discriminate whether the cartridges for the respective colors that are mounted to the main body of the image forming apparatus are the first cartridges or the second cartridges. In the embodiment, the type of cartridges is discriminated as a result of the memory tag readers 101 reading information regarding the cartridges and stored in the memory tags M of the respective cartridges.

In the embodiment, the memory tags M and the memory tag readers 101 are discriminating devices M·101 that discriminate between when the first cartridges are used and when the second cartridges are used. On the basis of the discrimination results of the discriminating devices, the controller 100 performs a controlling operation so that the maximum toner amount with respect to each photosensitive drum 1 when the first cartridges are used differs from that when the second cartridges are used.

Figure 4:
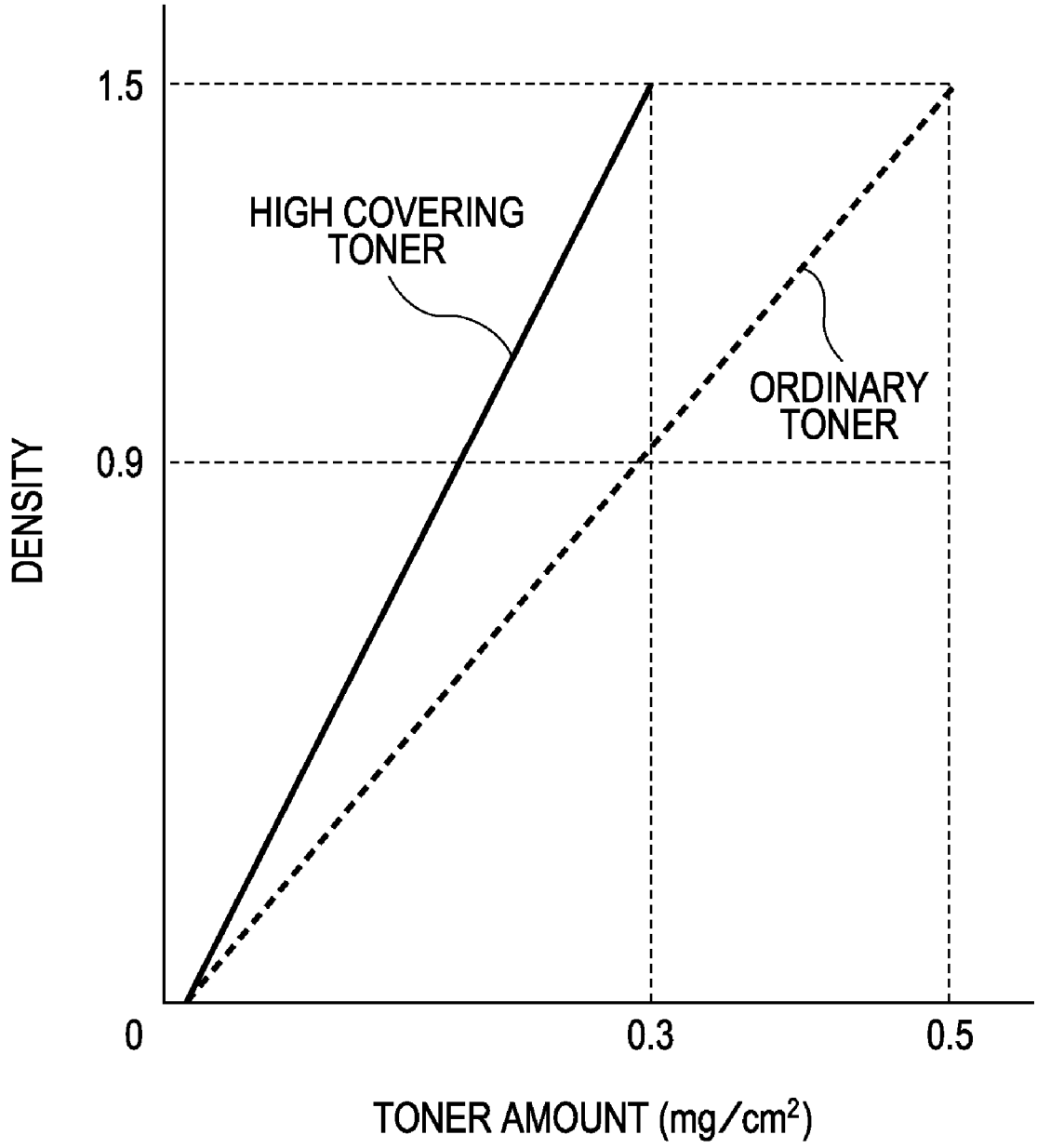
FIG. 4 is a graph showing covering power of toner (that is, the relationship between toner amount and density).

In the embodiment, the ordinary toner contained in the first cartridges is, for example, pigment 5. As shown by the dotted line in FIG. 4, the relationship between the density and the toner amount of ordinary toner is such that the density is 0.9 when the toner amount is 0.3 mg/cm$^2$, and the density is 1.5 when the toner amount is 0.5 mg/cm$^2$. The toner charging amount per unit weight (Q/M) is −30 μC/mg for each color.

The high covering toner contained in the second cartridges is, for example, pigment 9, and has a coloration amount that is greater than that of the aforementioned ordinary toner. As shown by the solid line in FIG. 4, the relationship between the density and the toner amount of high covering toner is such that the density is 1.5 when the toner amount is 0.3 mg/cm$^2$. As with the ordinary toner, the toner charging amount per unit weight (Q/M) is −30 μC/mg for each color.

Therefore, the toner amount used when the maximum density is 1.5 is 0.5 mg/cm$^2$ for the first cartridges containing ordinary toner, and is 0.3 mg/cm$^2$ for the second cartridges containing high covering toner. Consequently, when the same image density is output, the amount of toner used for the second cartridges is smaller than that for the first cartridges, so that running costs can be reduced.

In the embodiment, the charging amounts per unit weight of ordinary toner and high covering toner are substantially the same. Therefore, the controller 100 performs controlling operations so that a development maximum contrast when the first cartridges are used differs from that when the second cartridges are used. More specifically, the development contrasts (drum charging electrical potentials) are changed, to adjust the maximum toner amount to 0.5 mg/cm$^2$ for the first cartridges, and to 0.3 mg/cm$^2$ for the second cartridges.

Figure 5:
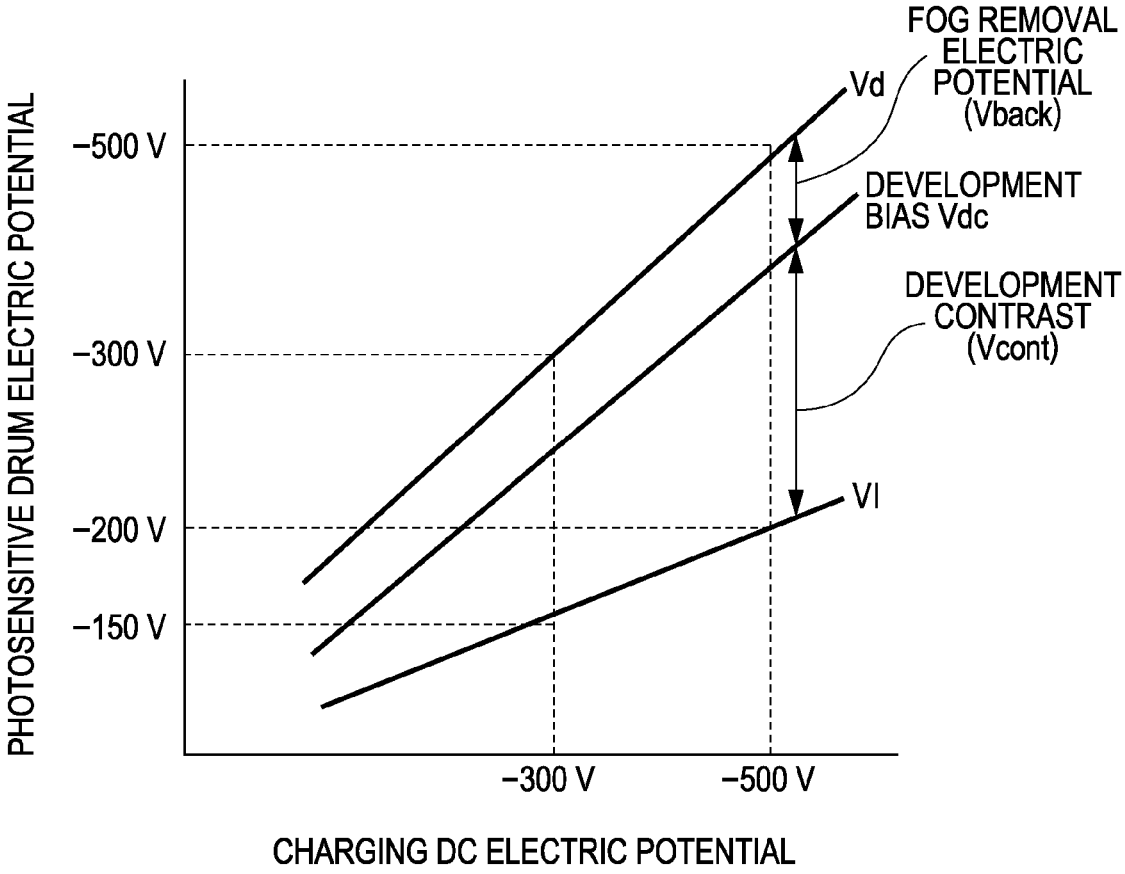
FIG. 5 is a graph showing development contrast.

Here, the development contrast will be described. FIG. 5 is a graph showing the relationship between development contrast Vcont and voltage at a charging DC bias Vdc. In the embodiment, the charging roller 2 is used as a charging member, and an AC+DC method is used for a high voltage for charging. A sinusoidal wave whose AC frequency is 1.0 kHz and whose Vpp is 1.6 kV is used. Since the AC+DC method is used, a charging DC electrical potential and a photosensitive-drum charging electrical voltage (Vd: photosensitive-drum dark-portion electrical potential) are substantially the same. A value obtained by subtracting a fog-removal electrical potential Vback from the development DC bias Vdc is output. The development contrast Vcont refers to the potential difference from the development DC bias Vdc to an electrical potential (V1: photosensitive-drum light-portion electrical potential) after exposure to laser.

Figure 6:
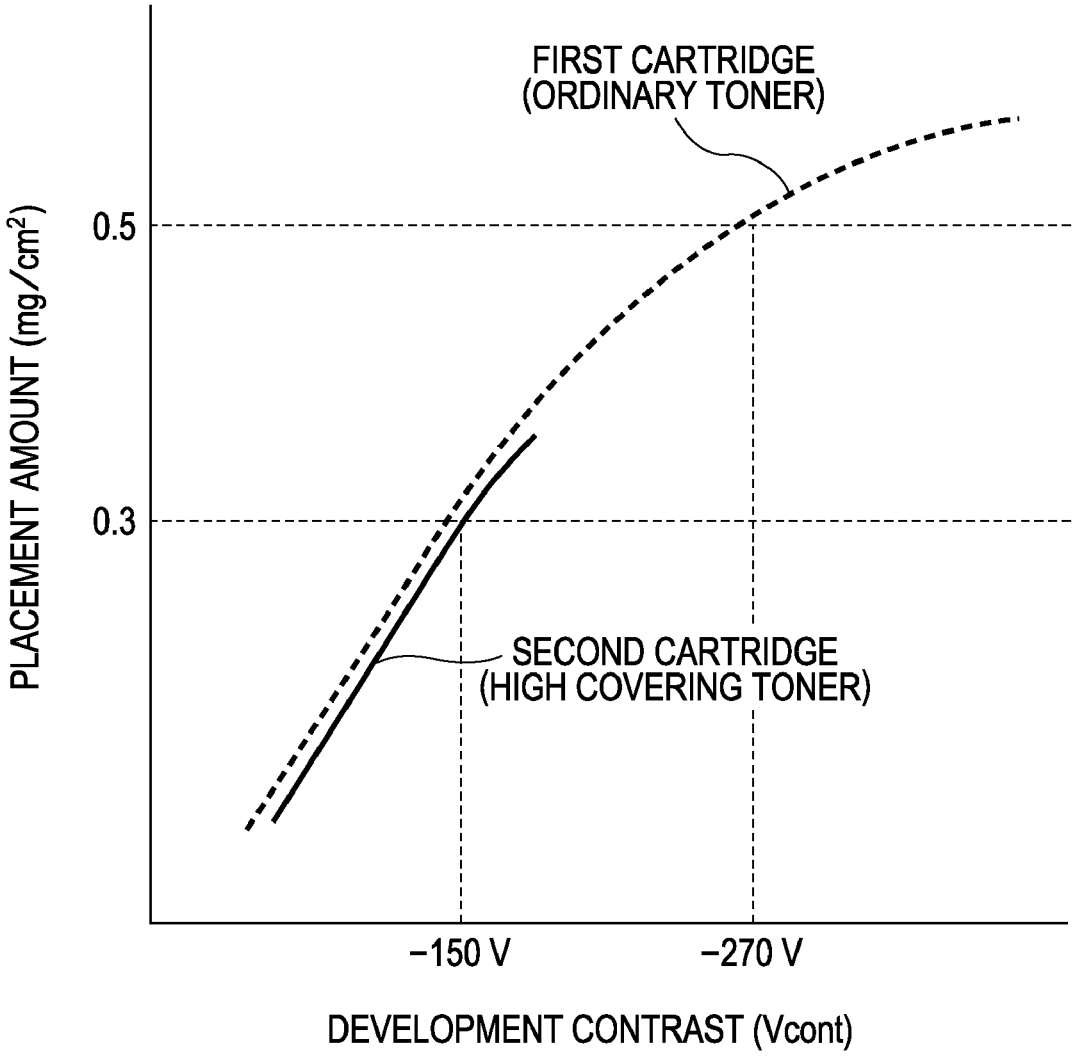
FIG. 6 is a graph showing the relationship between development contrast and toner amount of the first and second cartridges.

The relationship between the development contrast Vcont and the toner amount is shown in FIG. 6. In the embodiment, since the toner charging amount per unit weight for the first cartridges containing ordinary toner and that of the second cartridges containing high covering toner are substantially the same, the relationship between the development contrast Vcont and the toner amount for the first cartridges and that for the second cartridges have curves whose loci are substantially the same. Therefore, for achieving a maximum toner amount of 0.5 mg/cm$^2$ for the first cartridges, the development contrast is set to 270 V. In addition, for achieving a maximum toner amount of 0.3 mg/cm$^2$ for the second cartridges, the development contrast is set to 150 V.

Figure 7:
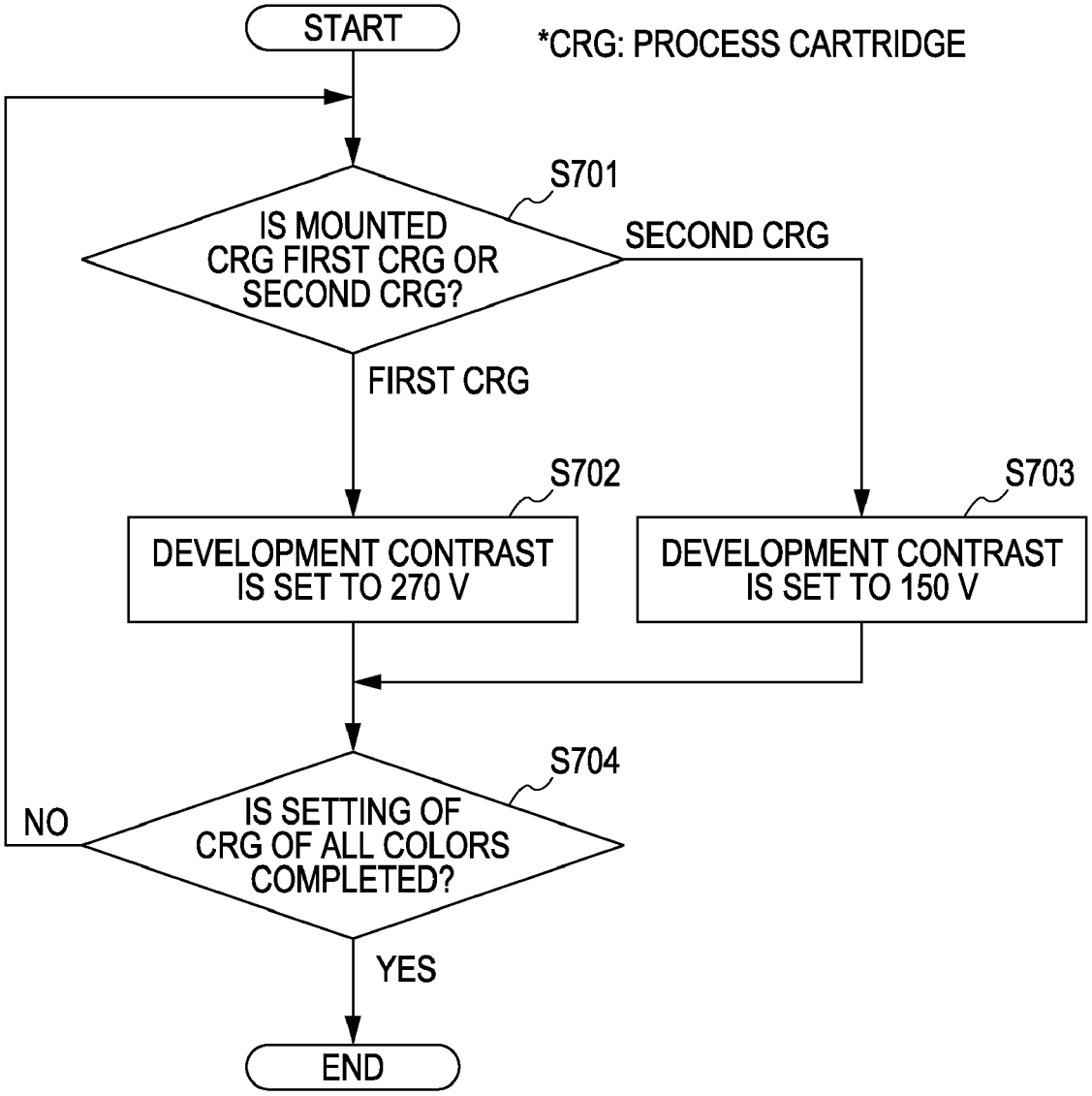
FIG. 7 is a flowchart of controlling operations.

A flowchart of the aforementioned controlling operations is shown in FIG. 7. When the power supply of the image forming apparatus is on, or after replacing cartridges, the controller 100 detects whether the cartridges that are mounted to the respective image forming sections UY, UM, UC, and UK are first cartridges or second cartridges (step S701). When the controller 100 detects that the cartridges are first cartridges, the development contrast of 270 V for the first cartridges is set (step S702). When the controller 100 detects that the cartridges are second cartridges, the development contrast of 150 V for the second cartridges is set (step S703). The controller 100 detects whether the setting of all of the cartridges mounted in the image forming sections UY, UM, UC, and UK is completed (step S704). When the controller 100 detects that the development contrasts are set for all of the cartridges mounted in the image forming sections UY, UM, UC, and UK, the process ends.

In the foregoing description, the cartridges mounted in the respective image forming sections UY, UM, UC, and UK are either the first cartridges 8Y-1, 8M-1, 8C-1, and 8K-1 or the second cartridges 8Y-2, 8M-2, 8C-2, and 8K-2. However, the present invention is not limited thereto. Both first and second cartridges may be mounted in the image forming sections, in which case the development contrasts for the first and second cartridges are set.

Figure 8:
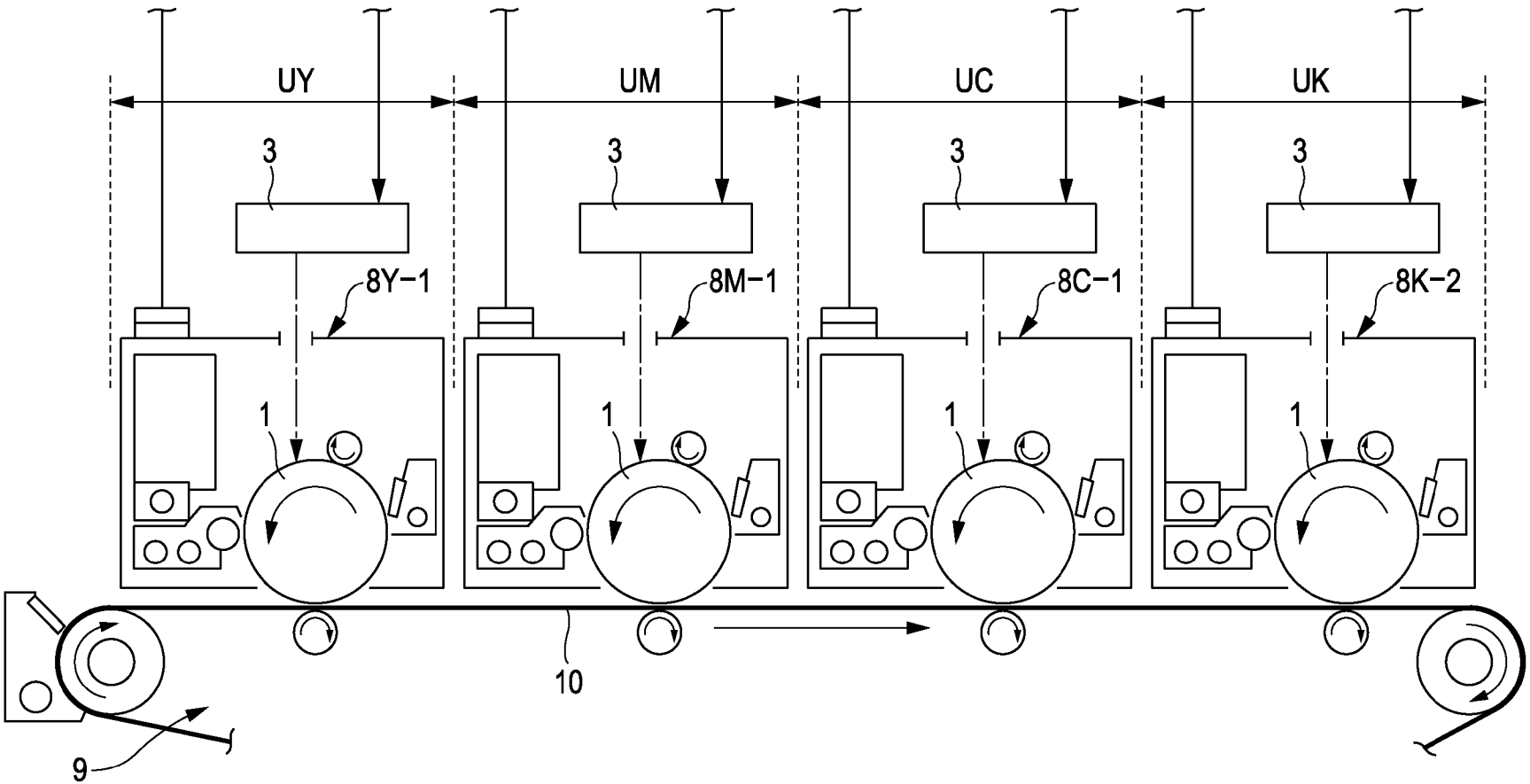
FIG. 8 shows an example in which the first and second cartridges are used.

For example, FIG. 8 shows that the cartridges mounted in the image forming sections UY, UM, and UC are the first cartridges 8Y-1, 8M-1, and 8C-1, respectively, whereas the cartridge mounted in the image forming section UK is the second cartridge 8K-2. Accordingly, when the first and second cartridges are mounted, the development contrasts for the first and second cartridges are set.

Figure 9:
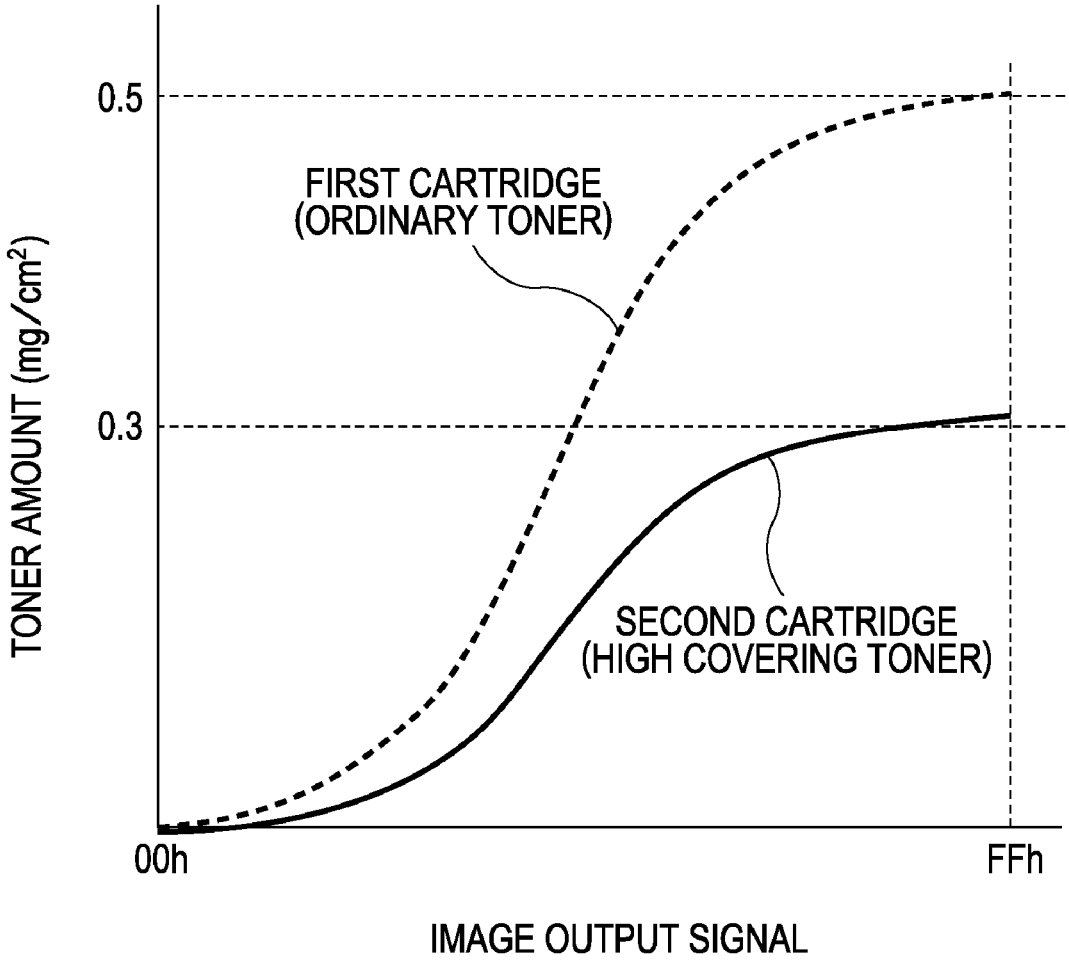
FIG. 9 is a graph showing the relationship between toner amount and image output signal for the first and second cartridges.

Consequently, the toner amounts with respect to image output signals (0~FFh) for the first cartridges 8Y-1, 8M-1, and 8C-1 and that for the second cartridge 8K-2 become as shown in FIG. 9. Accordingly, the maximum toner amounts (that is, the toner amounts for the image output signal FFh) may be changed to 0.5 mg/cm$^2$ for the first cartridges and to 0.3 mg/cm$^2$ for the second cartridge.

In the embodiment, when the first and second cartridges are changed, the development contrasts are changed to change the maximum toner amounts. This makes it possible to form a high-quality image (for example, an image in which sheet fibers appear is not formed) without limiting the toner amount to a small amount at the first cartridges. In addition, using the second cartridge, it is possible to form an image at low running costs as a result of limiting the toner amount to a small value while making it possible to restrict density variations and color variations.

Second Embodiment

In a second embodiment, a toner charging amount per unit weight (μC/mg) for a first cartridge containing ordinary toner and that for a second cartridge containing high covering toner are changed. This makes it possible to change maximum toner amounts with respect to photosensitive drums 1 so that the toner maximum amount when the first cartridge is used differs from that when the second cartridge is used.

The structure of the main body of the image forming apparatus according to the second embodiment is similar to that of the main body of an image forming apparatus according to the first embodiment. A two-component development method is used in developing devices 4.

Figure 10:
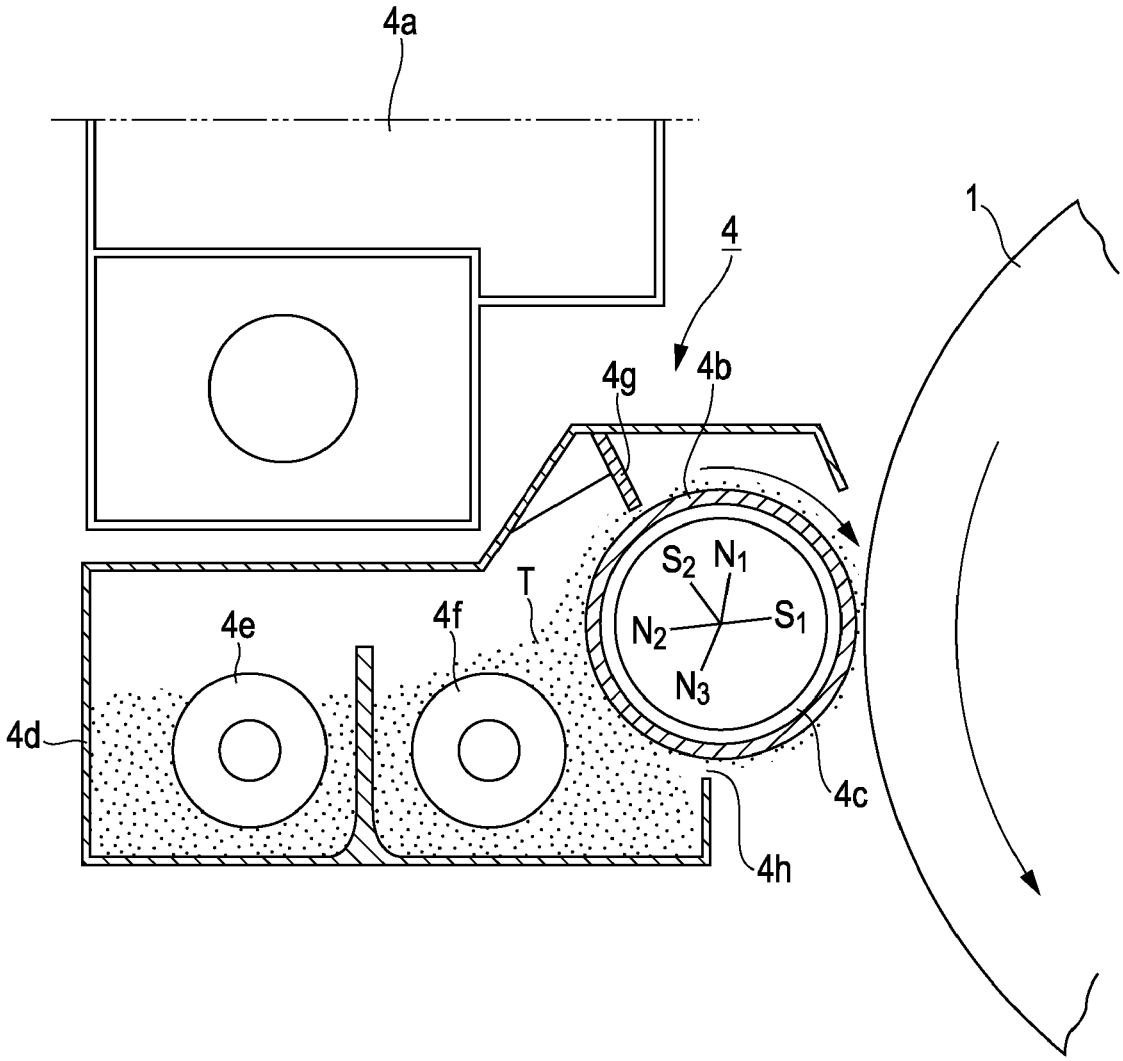
FIG. 10 illustrates a two-component developing device used in a second embodiment.

The developing device 4 using the two-component development method will be described with reference to FIG. 10. Reference numeral 4*b* denotes a development sleeve, reference numeral 4*c* denotes a magnet roller fixedly disposed in the interior of the development sleeve 4*b*, reference numeral 4*d* denotes a development container, and reference numerals 4*e* and 4*f* each denote a developing-agent agitation screw. Reference numeral 4*g* denotes a regulating blade disposed for forming a thin layer on the surface of the development sleeve 4*b*, and reference numeral 4*h* denotes a development opening of the development container 4*d*.

A development step, in which an electrostatic latent image on the surface of a photosensitive drum 1 is developed by the developing device 4 using a two-component magnetic brush method, and a circulating system of a developing agent T will hereunder be described. First, as the development sleeve 4*b* rotates, the developing agent T, which has been drawn up by a magnetic pole $N_2$, is regulated by the regulating blade 4*g* (disposed so as to be separated from the development sleeve 4*b* by an S-B gap) in a process in which the developing agent is conveyed along magnetic poles $S_2$ and $N_1$. This causes a thin layer of the two-component developing agent T to be formed on the development sleeve 4*b*. Here, when the developing agent that has been formed into the thin layer is conveyed to a development main pole $S_1$, a magnetic brush is formed by a magnetic force. The magnetic brush, formed when the developing agent is formed into spikes, is used to develop the electrostatic latent image on the photosensitive drum 1 to be developed into a developed toner image. The developing agent, which has been placed on the development sleeve 4*b* and which has developed the electrostatic latent image, is, then, recovered to the interior of the development container 4*d* by a repulsive magnetic field between the magnetic pole $N_2$ and a magnetic pole $N_3$.

In the embodiment, the following type of magnetic carrier of the two-component developing agent T is used. That is, a ferrite magnetic carrier having a saturation magnetization of 24 Am$^2$/kg with respect to an applied magnetic field of 240 kA/m, having a specific resistance of $1\times10^{7\sim8}$ o·cm with respect to an electric field strength of 3000 V/cm, and having a weight average particle diameter of 50 μm is used. As nonmagnetic toner, a negative-electric polyester resin toner including hydrophobic colloidal silica externally added to coloring resin particles and having a weight average particle diameter of 7.2 μm is used.

The magnetic carrier may be a resin magnetic carrier formed by a polymerization method using a binder resin, a magnetic metallic oxide, and a nonmagnetic metallic oxide as starting materials. The method of producing these magnetic carriers is not particularly limited. The nonmagnetic toner may be styrene acrylic resin toner. The ratio between the weight of the nonmagnetic toner and the weight of the magnetic carrier is defined as a TD ratio (=toner weight/(toner weight+carrier weight).

The charging amount per unit weight of ordinary toner is set to approximately −30 μC/mg, and the charging amount per unit weight of high covering toner is set to approximately −50 μC/mg. These values are set by changing the controlling of the TD ratio.

Figure 11:
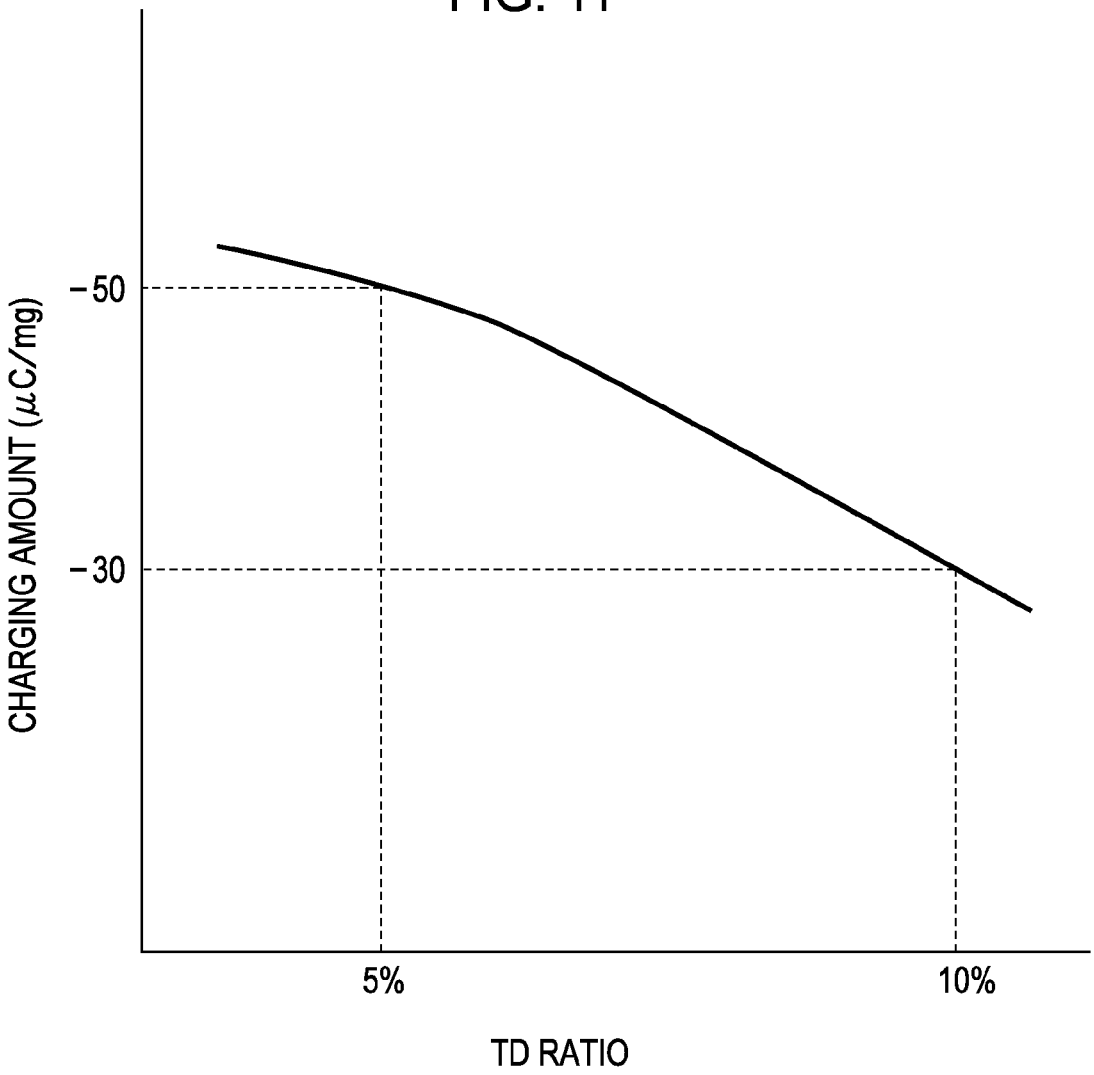
FIG. 11 is a graph showing the relationship between TD ratio and charging amount per unit weight.

The relationship between the TD ratio and the charging amount per unit weight is shown in FIG. 11. As the TD ratio increases, the number of contacts between the toner and the carrier is reduced, thereby reducing the charging amount per unit weight of toner. As the TD ratio is reduced, the number of contacts between the toner and the carrier is increased, thereby increasing the charging amount per unit weight of the toner.

By setting the TD ratio of ordinary toner to 10% and the TD ratio of high covering toner to 5%, the charging amount per unit weight of ordinary toner is set to −30 μC/mg, and the charging amount per unit weight of high covering toner is set to =50 μC/mg.

Figure 12:
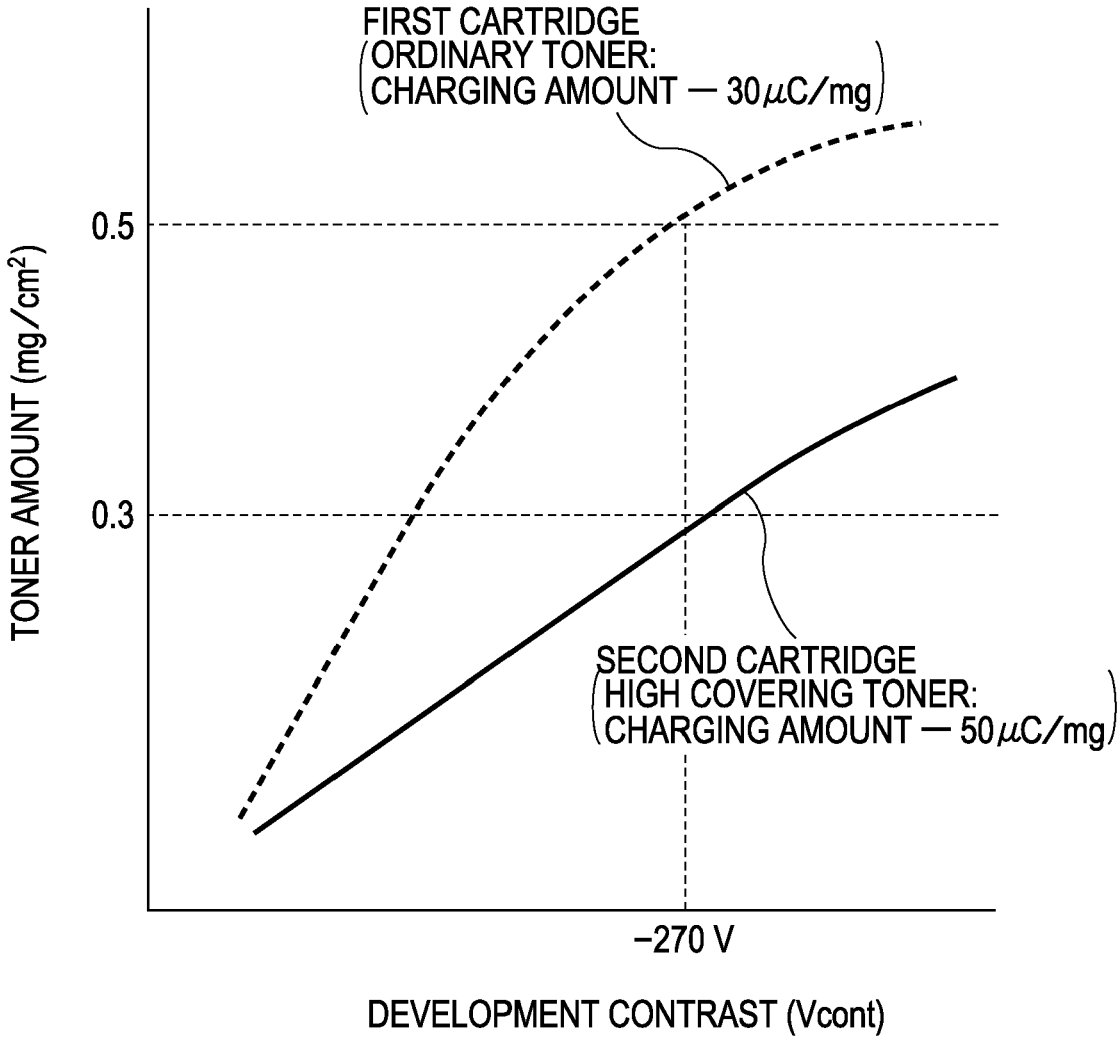
FIG. 12 is a graph showing the relationship between development contrast and toner amount of first and second cartridges.

As mentioned above, the toner charging amount per unit weight (Q/M) for the first cartridge is made different from that for the second cartridge. Accordingly, as shown in FIG. 12, the toner amounts for the first and second cartridges can be set to target values with respect to the same development contrast of 270 V, that is, to 0.5 mg/cm$^2$ for the first cartridge and to 0.3 mg/cm$^2$ for the second cartridge.

In the embodiment, when the first cartridge and the second cartridge are changed, the toner charging amounts per unit weight are changed by changing the TD ratio of the developing agent.

This makes it possible to form a high-quality image (for example, an image in which sheet fibers appear is not formed) without limiting the toner amount to a small amount at the first cartridge. In addition, using the second cartridge, it is possible to form an image at low running costs as a result of limiting the toner amount to a small value.

In the embodiment, although the toner charging amounts per unit weight for the first and second cartridges are changed by changing the TD ratio of the developing agent, the toner charging amounts per unit weight may be changed by changing the externally added toner amount or externally added agent type, or by changing the carrier.

Third Embodiment

As in the first embodiment, in a third embodiment, a discriminating device M·101 discriminates whether or not cartridges that are mounted are first cartridges or second cartridges. In the third embodiment, on the basis of a discrimination result, a controller 100 changes a maximum toner amount when the first cartridges are used and that when the second cartridges are used by changing a maximum exposure amount of a photosensitive drum 1 when the first cartridges are used and that when the second cartridges are used.

As in the first embodiment, in the third embodiment, a toner charging amount per unit weight for the first cartridges containing ordinary toner is substantially the same as a toner charging amount per unit weight for the second cartridges containing high covering toner.

As in the first embodiment, in the third embodiment, an exemplary structural view of a main body of an image forming apparatus shown in FIG. 1 comprises a plurality of cartridges shown in FIG. 3.

The cartridges have the same structure as the cartridges shown in FIG. 3. The cartridges for ordinary toner (hereafter generically referred to as "second cartridges") are represented by 8Y-1, 8M-1, 8C-1, and 8K-1. These cartridges are filled with toner (such as pigment 5) whose amount is small per unit weight. The relationship between toner amount and density is represented by a dotted line in FIG. 4. The density is 0.9 when the toner amount is 0.3 mg/cm$^2$, and the density is 1.5 when the toner amount is 0.5 mg/cm$^2$. The toner charging amount per unit weight is −30 μC/mg for each color.

The cartridges for high covering toner (hereafter generically referred to as "first cartridges") are represented by 8Y-2, 8M-2, 8C-2, and 8K-2. These cartridges are filled with toner (such as pigment 9) whose amount is large per unit weight. The relationship between toner amount and density is represented by a solid line in FIG. 4. The density is 1.5 when the toner amount is 0.3 mg/cm$^2$. The toner charging amount per unit weight is also −30 μC/mg for each color.

Therefore, the toner amount used when the maximum density is 1.5 is 0.5 mg/cm$^2$ for the second cartridges and is 0.3 mg/cm$^2$ for the first cartridges. When the same image density is output, the amount of toner used for the first cartridges is less than that for the second cartridges, thereby reducing running costs.

The toner charging amount per unit weight for the first cartridges is substantially the same as that for the second cartridges. Therefore, when the first and second cartridges are used, the laser exposure amounts are changed, to adjust the maximum toner amount to 0.5 mg/cm$^2$ for the second cartridges, and to 0.3 mg/cm$^2$ for the first cartridges.

Development contrast will be described. FIG. 5 is a graph showing the relationship between the development contrast and voltage at the charging DC bias. In the embodiment, a charging roller is used as a charging member, and an AC+DC method is used for a high voltage for charging. A sinusoidal wave whose AC frequency is 1.0 kHz and whose Vpp is 1.6 kV is used. Since the AC+DC method is used, the charging DC electrical potential and the drum charging electrical voltage (Vd) are substantially the same. A value obtained by subtracting a fog-removal electrical potential (Vback) from the development DC bias Vdc is output. The development contrast refers to the potential difference from the development DC bias to the electrical potential (V1) after exposure to laser.

Figure 15:
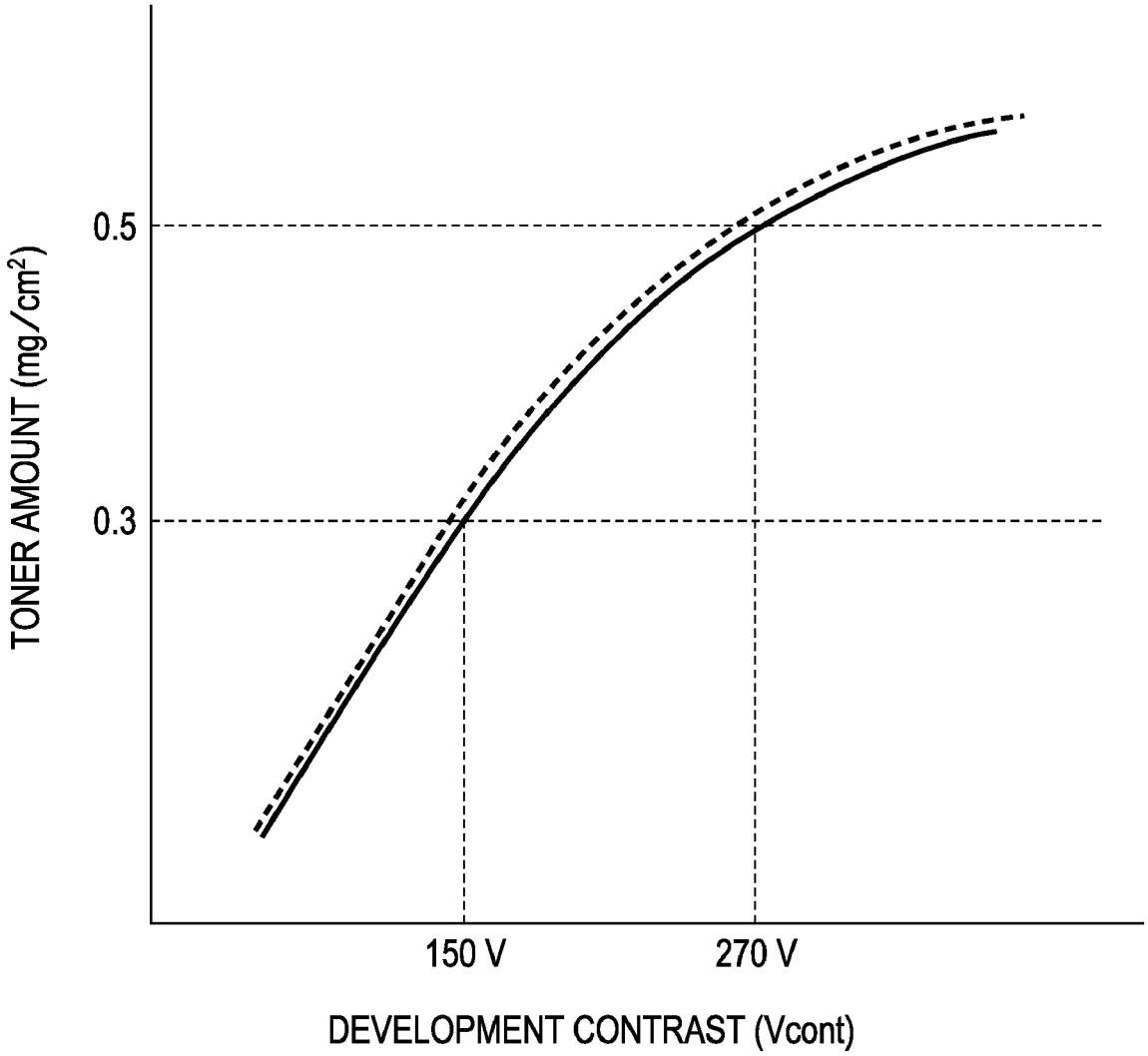
FIG. 15 is a graph showing the relationship between development contrast (potential difference from charging potential to development DC bias) and toner amount according to a third embodiment.

FIG. 15 is a graph showing the relationship between development contrast (potential difference from charging potential to development DC bias) and toner amount. The dotted line shows the relationship for the second cartridges, while the solid line shows the relationship for the first cartridges. In the embodiment, since the toner charging amounts per unit weight are substantially the same, the curves have substantially the same loci. Therefore, when the development contrasts are the same at 270 V, the maximum toner amounts for the second cartridges and the first cartridges are 0.5 mg/cm$^2$. In this case, for the second cartridges, the density is 1.5 when the maximum toner amount is 0.5 mg/cm$^2$, which is suitable. However, for the first cartridges, the density is too high when the maximum toner amount is 0.5 mg/cm$^2$.

Figure 16:
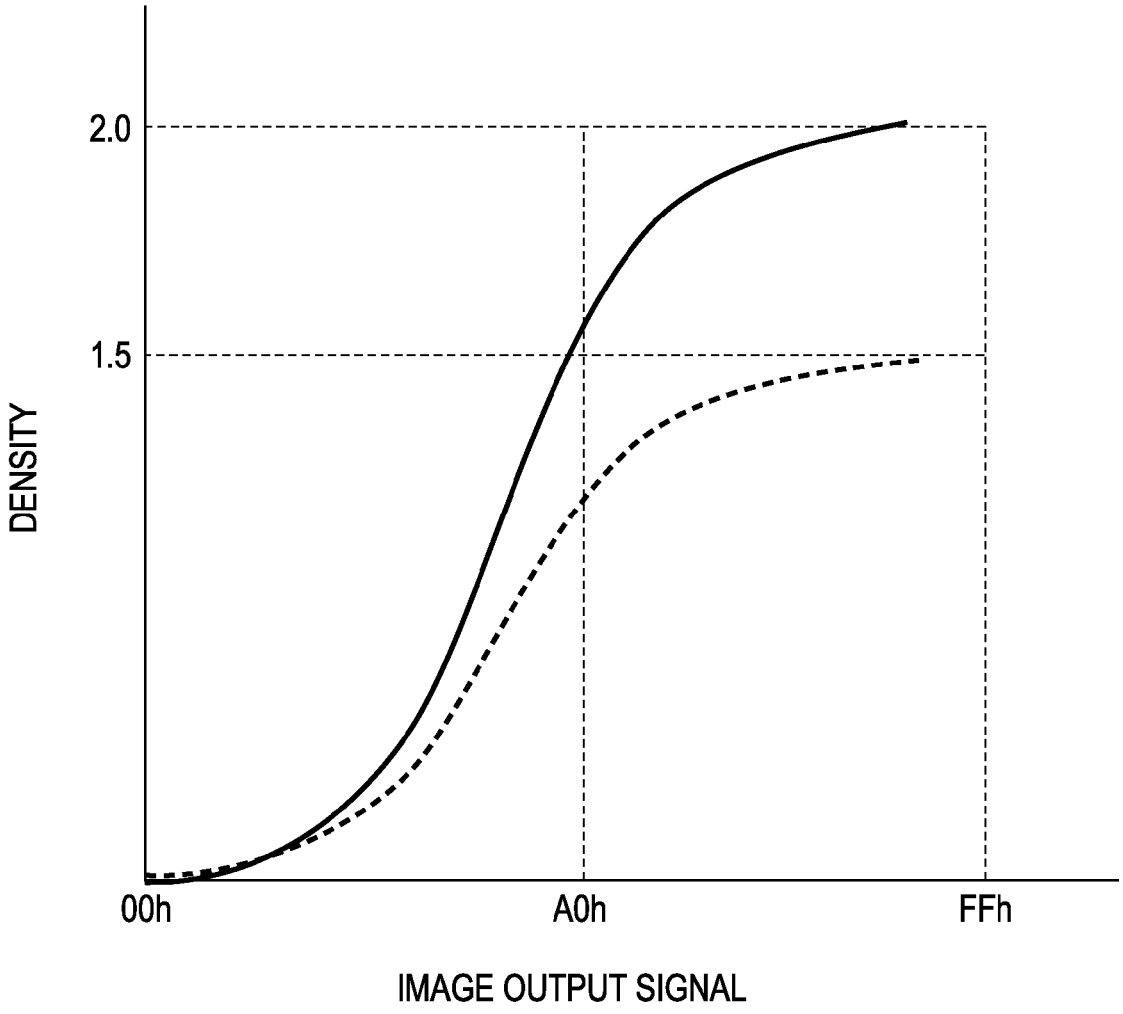
FIG. 16 is a graph showing the relationship between density and laser output when the development contrast is 270 V according to the third embodiment.

FIG. 16 is a graph showing the relationship between density and laser output when the development contrast is 270 V. The laser output has 256 gradations in 8 bits. Since a laser level FFh corresponds to a density of 1.5 for 1D-CRG, a laser level from 00h to FFh is used for the second cartridges. When the first cartridges are used, the density is 1.5 when the laser level is A0h. Therefore, when the first cartridges are used, a maximum density of 1.5 is achieved when the maximum toner amount is 0.3 mg/cm$^2$ as a result of only using the laser level from 00h to A0h. As a laser gradation controlling method, any method, such as a method using a pulse width modulator (PWM) or an intensity modulation method, may be used.

Although, in the embodiment, the maximum toner amounts for the first and second cartridges are changed by changing the exposure amounts of the photosensitive members as a result of changing the laser output levels (video values), it is possible to change the exposure amounts by changing maximum light-emission amounts of laser.

In the embodiment, when the first and second cartridges are changed, the maximum toner amounts are changed by changing the amounts of exposure to the photosensitive members achieved by scanner units 3 (that is, by changing light irradiation conditions). This makes it possible to form a high-quality image (for example, an image in which sheet fibers appear is not formed) without limiting the toner amount to a small amount at the second cartridges. In addition, using the first cartridges, it is possible to form an image at low running costs as a result of limiting the toner amount to a small value.

Other (1) Although, in each of the embodiments, the image forming apparatus is an electrophotography-process image forming apparatus, the image forming apparatus may be an electrostatic-recording-process image forming apparatus using an electrostatic recording dielectric member as an image bearing member, or a magnetic-recording-process image forming apparatus using a magnetic-recording magnetic member as an image bearing member.

(2) The image forming apparatus is not limited to a multicolor or a full-color image forming apparatus in which a plurality of process cartridges are disposed in a tandem arrangement. The image forming apparatus may be a monocolor image forming apparatus using one removable process cartridge.

(3) The image forming apparatus is not limited to one using an intermediate transfer method. The image forming apparatus may be one that forms an image on a recording material by directly transferring a toner image, formed on an image bearing member, onto a recording material P.

(4) The image forming apparatus may be formed by providing three or more cartridges, containing toners having the same hue and having different densities, and by selectively mounting one of the cartridges to a mounting device.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-266330 filed Oct. 12, 2007, which is hereby incorporated by reference herein in its entirety.

What is claimed is:

1. An image forming apparatus using an electrophotography, the image forming apparatus comprising:

a mounting device configured to detachably mount a selected one cartridge of a plurality of cartridges, wherein the plurality of cartridges includes a cartridge containing a dark color toner and a cartridge containing a light color toner which are configured to form a toner image, and wherein the dark color toner and the light color toner have a same hue and such a brightness relationship that, in an image forming operation, a toner amount per unit area of the toner image of the dark color toner is smaller than a toner amount per unit area of the toner image of the light color toner on condition that an image density of the toner image of the dark color toner is same as an image density of the toner image of the light color toner; and a controller configured to change an image forming condition so that a maximum toner amount per unit area of the toner image of the dark color toner used when the cartridge containing a dark color toner is mounted to the mounting device is smaller than maximum toner amount per unit area of the toner image of the light color toner used when the cartridge containing a light color toner is mounted to the mounting device.

2. An image forming apparatus according to claim 1, further comprising a discriminating device configured to discriminate a type of the plurality of cartridges, wherein the controller changes the image forming condition based on an output of the discriminating device.

3. An image forming apparatus according to claim 2, wherein each cartridge of the plurality of cartridges is provided with a memory, and the discriminating device includes a reader configured to read information from each memory.

4. An image forming apparatus according to claim 1, wherein a plurality of sets of the cartridge containing a dark color toner and the cartridge containing a light color toner are provided for yellow toner, magenta toner, cyan toner, and black toner.

5. An image forming apparatus according to claim 1, further comprising a light emitting device configured to emit light to a photosensitive member based on image information, wherein the image forming condition includes a light emitting condition of the light emitting device.

* * * * *